US009361842B2

(12) United States Patent
Kim et al.

(10) Patent No.: US 9,361,842 B2
(45) Date of Patent: Jun. 7, 2016

(54) DISPLAY PANEL DRIVING APPARATUS AND DISPLAY APPARATUS HAVING THE SAME

(71) Applicant: Samsung Display Co., Ltd., Yongin (KR)

(72) Inventors: Tae-Gon Kim, Busan (KR); Won-Tae Kim, Cheongju-si (KR); Sun-Kyu Son, Suwon-si (KR); Jae-Han Lee, Hwaseong-si (KR); Yong-Bum Kim, Suwon-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 48 days.

(21) Appl. No.: 14/208,793

(22) Filed: Mar. 13, 2014

(65) Prior Publication Data

US 2015/0042631 A1 Feb. 12, 2015

(30) Foreign Application Priority Data

Aug. 7, 2013 (KR) ..... 10-2013-0093412

(51) Int. Cl.
*G09G 3/36* (2006.01)

(52) U.S. Cl.
CPC ..... *G09G 3/3655* (2013.01)

(58) Field of Classification Search
CPC ..... G09G 3/36; G09G 3/3655; G09G 3/3696; G09G 2310/0243; G09G 2310/0264; G09G 2310/0286; G09G 2310/0291
See application file for complete search history.

(56) References Cited

U.S. PATENT DOCUMENTS

| | | | | |
|---|---|---|---|---|
| 6,184,854 | B1 * | 2/2001 | Hotto et al. | 345/89 |
| 7,760,199 | B2 | 7/2010 | An | |
| 8,416,164 | B2 | 4/2013 | Hwang et al. | |
| 2004/0164943 | A1 | 8/2004 | Ogawa et al. | |
| 2008/0001903 | A1 | 1/2008 | Chung et al. | |
| 2014/0098012 | A1 * | 4/2014 | Woo et al. | 345/89 |

FOREIGN PATENT DOCUMENTS

| | | | |
|---|---|---|---|
| KR | 10-2008-0062481 | | 7/2008 |
| KR | 1020060138356 | * | 7/2008 |
| KR | 10-2011-0070356 | | 6/2011 |
| KR | 10-2012-0122205 | | 11/2012 |

* cited by examiner

*Primary Examiner* — Charles Hicks
(74) *Attorney, Agent, or Firm* — H.C. Park & Associates, PLC

(57) ABSTRACT

A display panel driving apparatus, including a gate driving part configured to output a gate signal to gate lines of a display panel, and a data driving part configured to output a data signal to a data line of the display panel, including a digital-analog converter, wherein the digital-analog converter is configured to convert a common voltage control data of digital format to a common voltage control voltage of analog format.

19 Claims, 7 Drawing Sheets

DISPLAY PANEL DRIVING APPARATUS AND DISPLAY APPARATUS HAVING THE SAME

CROSS REFERENCE TO RELATED APPLICATION

This application claims priority from and the benefit of Korean Patent Application No. 10-2013-0093412, filed on Aug. 7, 2013 which is hereby incorporated by reference for all purposes as if fully set forth herein.

BACKGROUND

1. Field

Exemplary embodiments of the present invention relate to a display panel driving apparatus and a display apparatus having the same. More specifically, exemplary embodiments of the present invention relate to a display panel driving apparatus outputting a common voltage to a display panel and a display apparatus having the same.

2. Discussion of the Background

A liquid crystal display panel of a liquid crystal display apparatus includes a lower substrate, an upper substrate and a liquid crystal layer interposed between the lower substrate and the upper substrate.

The lower substrate includes a first base substrate, a gate line and a data line formed on the first base substrate, a switching element electrically connected to the gate line and the data line, and a pixel electrode electrically connected to the switching element.

The upper substrate includes a second base substrate facing the first base substrate, a color filter formed on the second base substrate, and a common electrode formed on the color filter.

The liquid crystal layer includes a liquid crystal of which alignment is changed according to an electric file by a pixel voltage applied to the pixel electrode and a common voltage applied to the common electrode.

The liquid crystal display panel receives the common voltage to display an image. Therefore, the liquid crystal display apparatus including the liquid crystal display panel may include a common voltage generating part to apply the common voltage to the liquid crystal display panel.

However, the number and length of transmission line cables such as a flexible flat cable (FFC) connecting the display panel with the common voltage generating part has increased due to the common voltage generating part.

In addition, the number of elements used to form the common voltage generating part is increased, increasing the manufacturing cost of the liquid crystal display apparatus including the common voltage generating part.

The above information disclosed in this Background section is only for enhancement of understanding of the background of the invention and therefore it may contain information that does not form any part of the prior art nor what the prior art may suggest to a person of ordinary skill in the art.

SUMMARY

Exemplary embodiments of the present invention provide a display panel driving apparatus capable of decreasing the number of lines transmitting a common voltage and decreasing manufacturing cost of a display apparatus.

Exemplary embodiments of the present invention also provide a display apparatus having the above-mentioned display panel driving apparatus.

Additional features of the invention will be set forth in the description which follows, and in part will be apparent from the description, or may be learned by practice of the invention.

An exemplary embodiment of the present invention discloses a display panel driving apparatus, including a gate driving part configured to output a gate signal to gate lines of a display panel, and a data driving part configured to output a data signal to a data line of the display panel, the data driving part including a digital-analog converter, wherein the digital-analog converter is configured to convert a common voltage control data of digital format to a common voltage control voltage of analog format.

An exemplary embodiment of the present invention also discloses a display apparatus, including a display panel configured to receive a data signal based on an image data to display an image, and a display panel driving apparatus including a gate driving part configured to output a gate signal to gate lines of a display panel, and a data driving part configured to output a data signal to a data line of the display panel, the data driving part including a digital-analog converter, wherein the digital-analog converter is configured to convert a common voltage control data of digital format to a common voltage control voltage of analog format.

According to the present invention, a common voltage generating part is in a data driving part, a data driving integrated circuit of the data driving part and the common voltage generating part share a digital-analog converter. Therefore, transmission lines of a cable such as a flexible flat cable (FFC) may be reduced, lowering the manufacturing cost of the display apparatus.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE INVENTION

Figure 1:
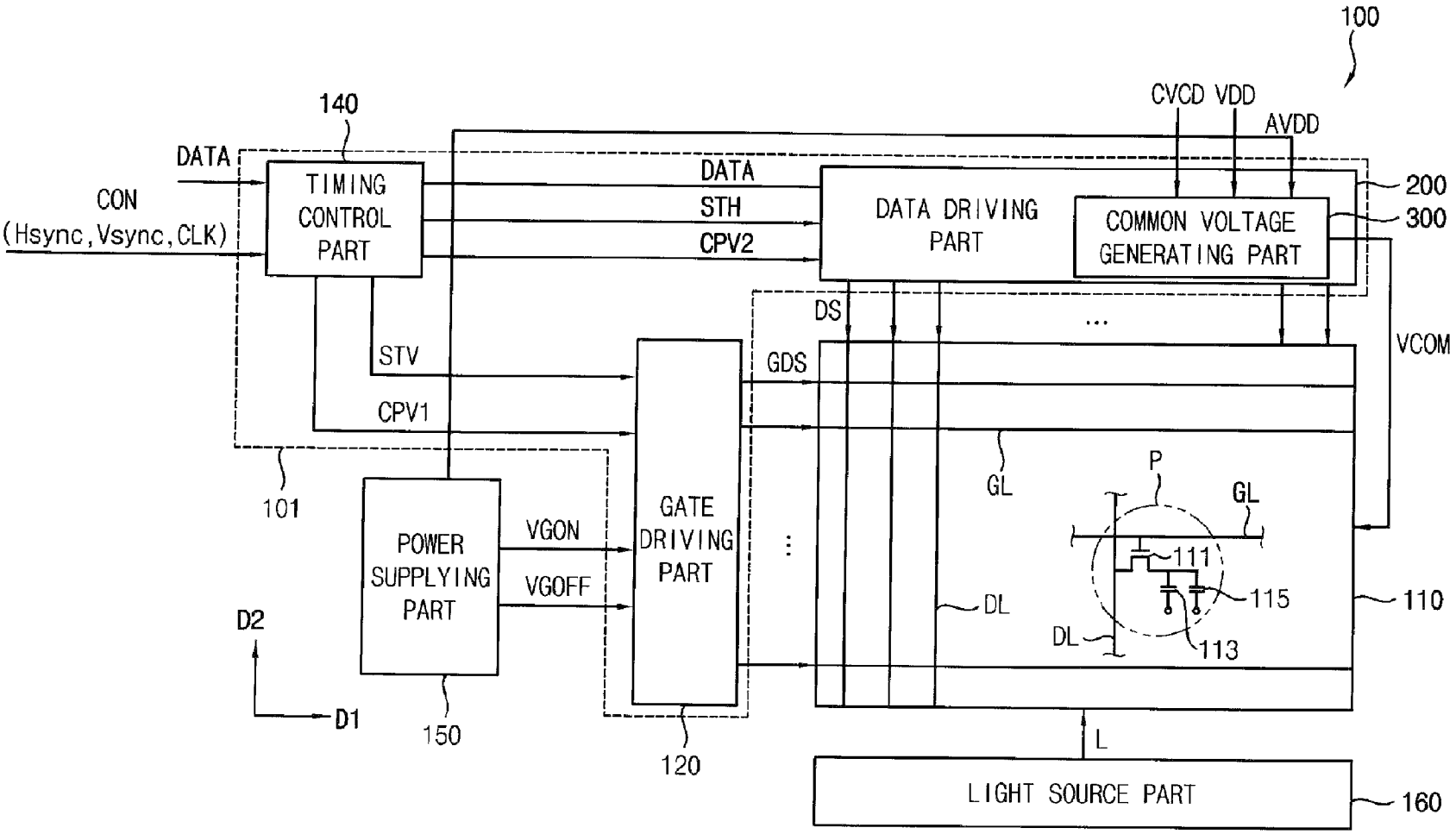
FIG. 1 is a block diagram illustrating a display apparatus according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element or layer is referred to as being "on" or "connected to" another element or layer, it can be directly on or directly connected to the other element or layer, or intervening elements or layers may be present. In contrast, when an element or layer is referred to as being "directly on" or "directly connected to" another element or layer, there are no intervening elements or layers present. It will be understood that for the purposes of this disclosure, "at least one of X, Y, and Z" can be construed as X only, Y only, Z only, or any combination of two or more items X, Y, and Z (e.g., XYZ, XYY, YZ, ZZ).

FIG. 1 is a block diagram illustrating a display apparatus according to an exemplary embodiment of the present invention.

Referring to FIG. 1, the display apparatus 100 includes a display panel 110 and a display panel driving apparatus 101.

The display panel 110 receives a data signal DS based on an image data DATA and displays an image. For example, the image data DATA may be two-dimensional plane image data. Alternatively, the image data DATA may include a left-eye image data and a right-eye image data for displaying a three-dimensional stereoscopic image.

The display panel 110 includes gate lines GL, data lines DL and a plurality of pixels P. The gate lines GL extend in a first direction D1 and the data lines DL extend in a second direction D2 substantially perpendicular to the first direction D1. The first direction D1 may be parallel with a long side of the display panel 110 and the second direction D2 may be parallel with a short side of the display panel 110. Each of the pixels P includes a thin film transistor 111 electrically connected to the gate line GL and the data line DL, a liquid crystal capacitor 113, and a storage capacitor 115 connected to the thin film transistor 111.

The display panel driving apparatus 101 includes a gate driving part 120, a data driving part 200 and a timing control part 140.

The gate driving part 120 generates a gate signal GS, in response to a gate start signal STV and a gate clock signal CPV1 provided from the timing control part 140, and outputs the gate signal GS to the gate line GL.

In exemplary embodiments, the gate driving part 120, and/or one or more components thereof, may be implemented via one or more general purpose and/or special purpose components, such as one or more discrete circuits, digital signal processing chips, integrated circuits, application specific integrated circuits, microprocessors, processors, programmable arrays, field programmable arrays, instruction set processors, and/or the like.

The data driving part 200 outputs the data signal DS based on the image data DATA to the data line DL, in response to a data start signal STH and a data clock signal CPV2 provided from the timing control part 140.

The data driving part 200 includes a common voltage generating part 300 providing a common voltage VCOM to the display panel 110. Specifically, the common voltage generating part 300 receives a common voltage control data CVCD for controlling the common voltage VCOM, a power voltage VDD and an analog voltage AVDD from an outside to generate the common voltage VCOM.

The timing control part 140 receives the image data DATA and a control signal CON from outside. The control signal CON may include a horizontal synchronous signal Hsync, a vertical synchronous signal Vsync and a clock signal CLK. The timing control part 140 generates the data start signal STH using the horizontal synchronous signal Hsync and outputs the data start signal STH to the data driving part 200. The timing control part 140 generates the gate start signal STV using the vertical synchronous signal Vsync, and outputs the gate start signal STV to the gate driving part 120. Also, the timing control part 140 generates the gate clock signal CPV1 and the data clock signal CPV2 using the clock signal CLK, outputs the gate clock signal CPV1 to the gate driving part 120 and outputs the data clock signal CPV2 to the data driving part 200.

The display apparatus 100 may further include a power supplying part 150. The power supplying part 150 provides a gate on voltage VGON and a gate off voltage VGOFF to the gate driving part 120, and provides the analog voltage AVDD to the common voltage generating part 300 in the data driving part 200.

The display apparatus 100 may further include a light source part 160 providing light L to the display panel 110. For example, the light source part 160 may include a light emitting diode (LED).

Figure 2:
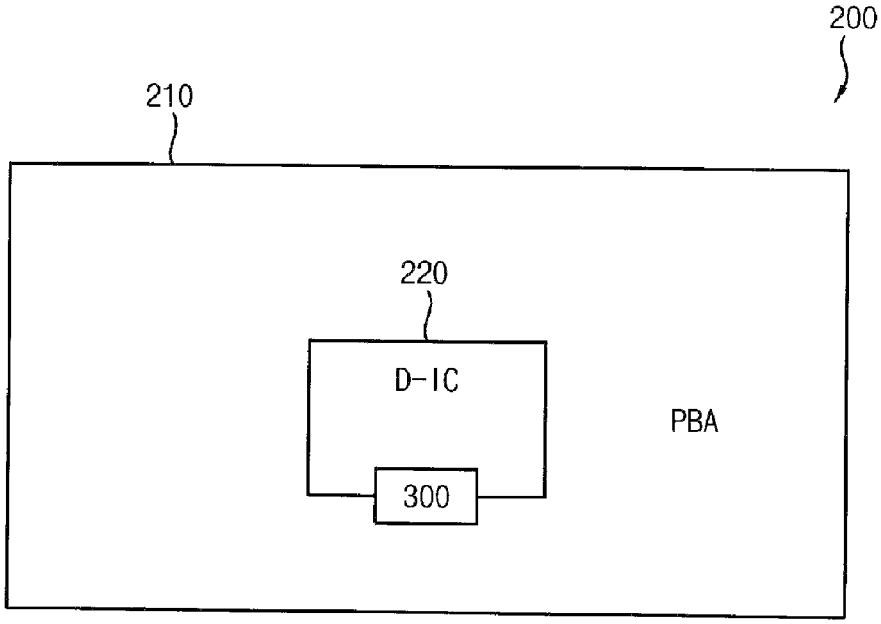
FIG. 2 is a block diagram illustrating a data driving part of FIG. 1.

FIG. 2 is a block diagram illustrating the data driving part 200 of FIG. 1.

Referring to FIGS. 1 and 2, the data driving part 200 includes a printed board assembly (PBA) 210 and a data driving integrated circuit 220 mounted on the PBA 210. The PBA 210 may be a substrate or a film on which the data driving integrated circuit 220 is mounted. In addition, the data driving part 200 includes the common voltage generating part 300. A portion of the common voltage generating part 300 may be disposed on the PBA 210, and the other portion of the common voltage generating part 300 may be included in the data driving integrated circuit 220.

Figure 3:
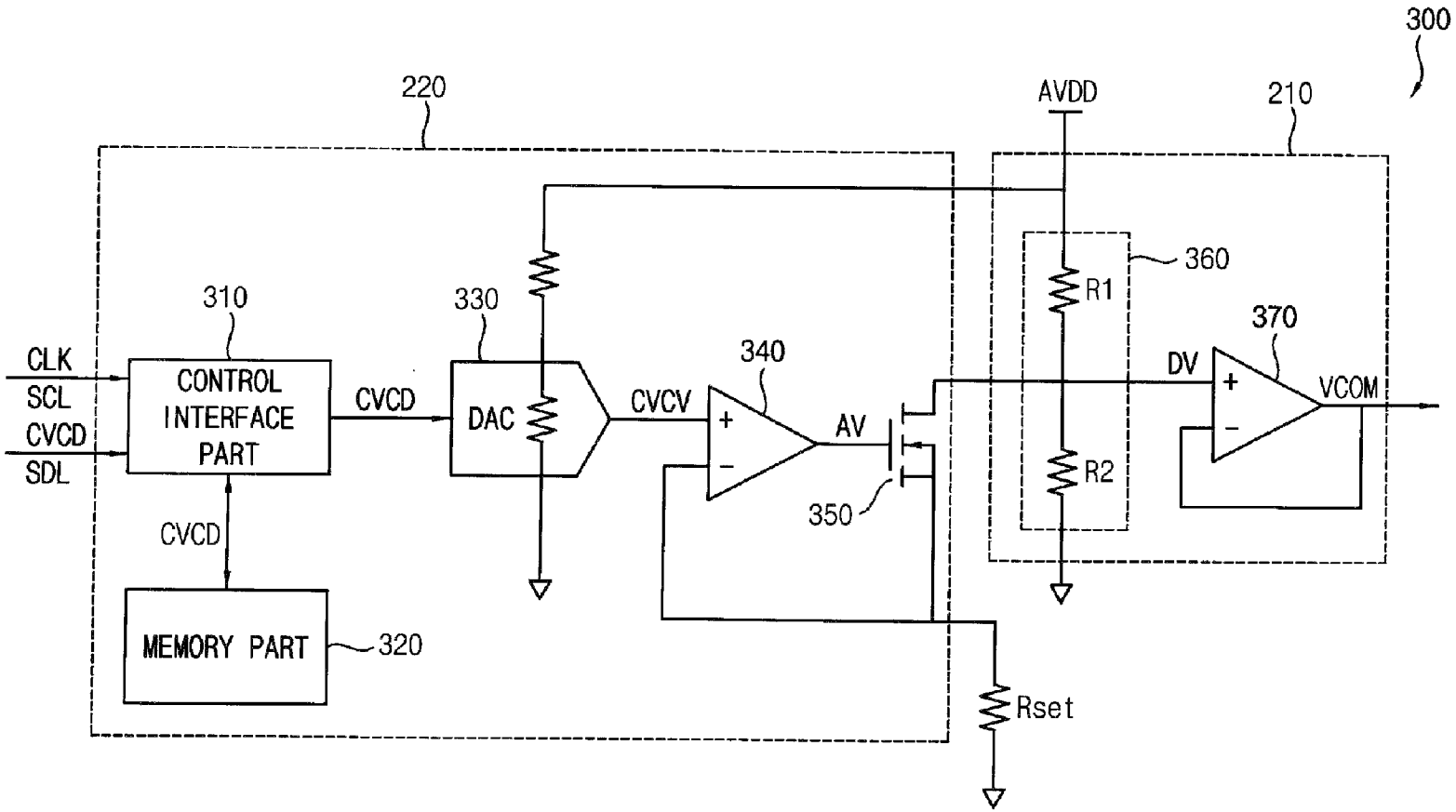
FIG. 3 is a block diagram illustrating a common voltage generating part in FIGS. 1 and 2.

FIG. 3 is a block diagram illustrating the common voltage generating part 300 in FIGS. 1 and 2.

Referring to FIGS. 1 to 3, the common voltage generating part 300 may include a control interface part 310, a memory part 320, a digital-analog converter 330, a first operational amplifier 340, a metal oxide semiconductor (MOS) transistor 350, a voltage distributing part 360 and a second operational amplifier 370. In the current exemplary embodiment, the control interface part 310, the memory part 320, the digital-analog converter 330, the first operational amplifier 340 and the MOS transistor 350 may be included in the data driving integrated circuit 220 and the voltage distributing part 360 and the second operational amplifier 370 may be disposed on the PBA 210.

The control interface part 310 receives the common voltage control data CVCD from the outside to output the common voltage control data CVCD to the digital-analog converter 330. The control interface part 310 may receive the common voltage control data CVCD through an inter-integrated circuit (I2C) communication. Thus, the control interface part 310 may receive a clock signal through a serial clock line SCL and receive the common voltage control data CVCD through a serial data line SDL. The control interface part 310 may receive the common voltage control data CVCD from the timing control part 140. Alternatively, the control interface part 310 may receive the common voltage control data CVCD from the memory part 320 storing the common voltage control data CVCD. For example, the control interface part 310 may be a Unified Standard Interface for TV (USI-T).

The memory part 320 receives the common voltage control data CVCD from the control interface part 310 and stores the common voltage control data CVCD. The memory part 320 may be an electrically erasable and programmable read only memory (EEPROM) capable of repeatedly storing the common voltage control data CVCD.

The digital-analog converter 330 converts the common voltage control data CVCD to output a common voltage control voltage CVCV. The common voltage control data CVCD may be digital type and the common voltage control voltage CVCV may be analog type. The digital-analog converter 330 may include a digital variable resistor DVR to convert the common voltage control data CVCD.

The first operational amplifier 340 amplifies the common voltage control voltage CVCV to output an amplified voltage AV, including a non-inverting terminal receiving the common voltage control voltage CVCV, an inverting terminal electrically connected to a reset resistor Rset, and an output terminal electrically connected to the MOS transistor 350 outputting the amplified voltage AV. A lower limit and an upper limit of the common voltage may be determined based on the reset resistor Rset. The reset resistor Rset includes a first terminal electrically connected to the inverting terminal of the first operational amplifier 340, and a second terminal connected a terminal to which a ground voltage is applied.

The MOS transistor 350 controls a sink current according to the amplified voltage AV. For example, the MOS transistor 350 may be an NMOS transistor.

The voltage distributing part 360 includes a first resistor R1 and a second resistor R2 electrically connected to a terminal to which the analog voltage AVDD is applied, and distributes the analog voltage AVDD to output a distribution voltage DV. The first resistor R1 and the second resistor R2 are serially connected. More specifically, a first terminal of the first resistor R1 is electrically connected to the terminal to which the analog voltage AVDD is applied, a second terminal of the first resistor R1 is electrically connected to a first terminal of the second resistor R2, and a second terminal of the second resistor R2 is electrically connected to the terminal to which the ground voltage is applied.

The second operational amplifier 370 includes a non-inverting terminal electrically connected to the voltage distributing part 360 receiving the distribution voltage DV, an output terminal outputting the common voltage VCOM, and an inverting terminal electrically connected to the output terminal.

Figure 4:
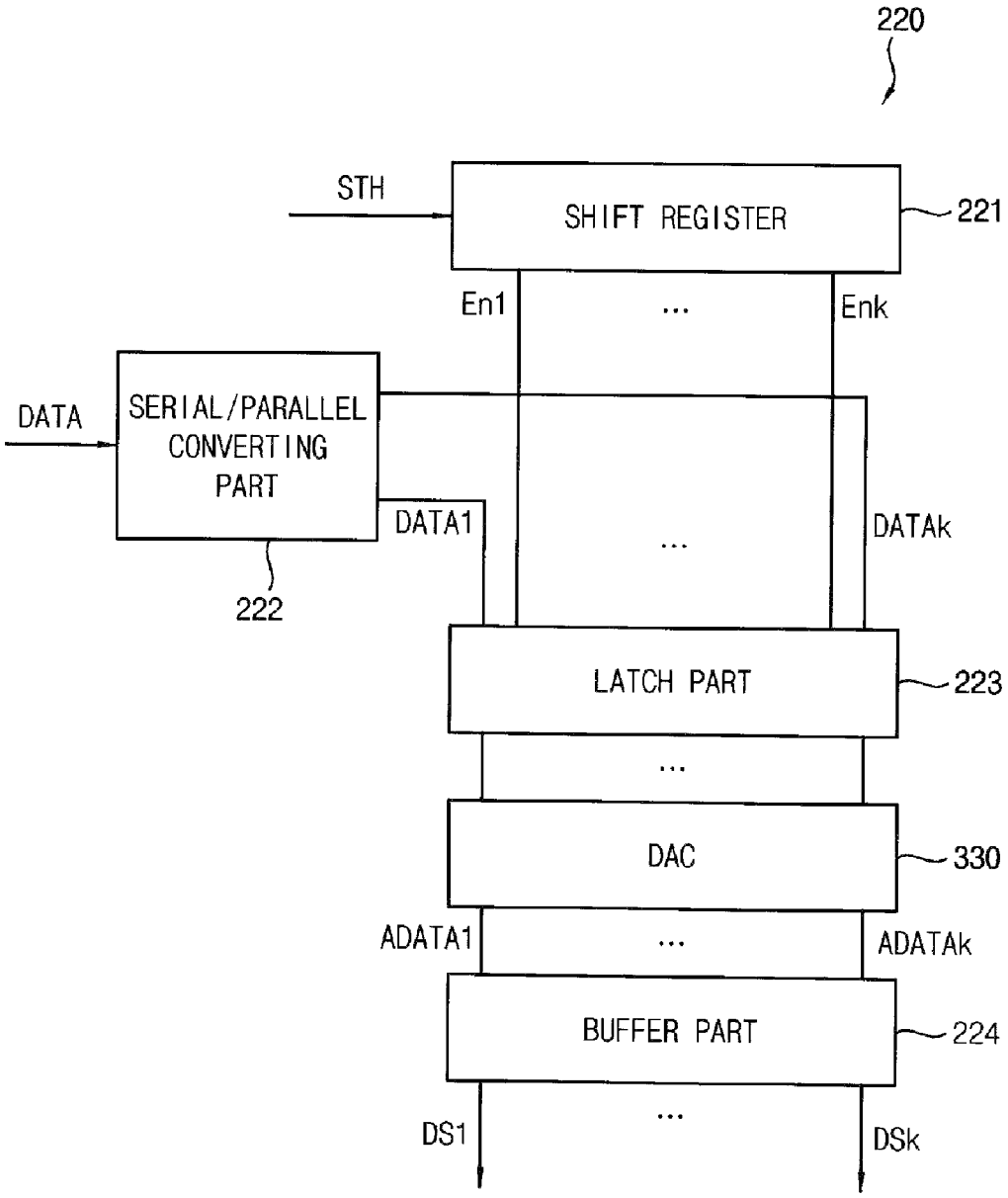
FIG. 4 is a block diagram illustrating a data driving integrated circuit of FIGS. 2 and 3.

FIG. 4 is a block diagram illustrating the data driving integrated circuit 220 of FIGS. 2 and 3.

Referring to FIGS. 1 to 4, the data driving integrated circuit 220 includes a shift register 221, a serial/parallel converting part 222, a latch part 223, the digital-analog converter 330 and a buffer part 224.

The shift register 221 outputs first to k-th enable signals En1-Enk, in response to the data start signal STH provided from the timing control part 140.

The serial/parallel converting part 222 receives the image data DATA and converts the image data DATA into parallel type to output first to k-th parallel data DATA1-DATAk.

More specifically, the shift register 221 sequentially outputs the first enable signal En1 to the k-th enable signal Enk, to sequentially store the first parallel data DATA1 to the k-th parallel data DATAk to the latch part 223. The latch part 223 outputs the first to k-th parallel data DATA1-DATAk to the digital-analog converter 330.

The digital-analog converter 330 converts the first to k-th parallel data DATA1-DATAk from the latch part 223, and outputs first to k-th analog data ADATA1-ADATAk to the buffer part 224. The first to k-th parallel data DATA1-DATAk may be digital format, and the first to k-th analog data ADATA1-ADATAk may be analog format.

The digital-analog converter 330 may be included in the data driving integrated circuit 220 and the common voltage generating part 300. Thus, the data driving integrated circuit 220 and the common voltage generating part 300 may share the digital-analog converter 330.

The buffer part 224 receives the first to k-th analog data ADATA1-ADATAk to output first to k-th data signals DS1-DSk to the data lines DL of the display panel 110. The first to k-th data signals DS1-DSk may be included in the data signals DS. According to an exemplary embodiment, the first operational amplifier 340 of the common voltage generating part 300 may be implemented using a buffer in the buffer part 224.

According to the present exemplary embodiment, the common voltage generating part 300 is included in the data driving part 200, and the data driving integrated circuit 220 and the common voltage generating part 300 share the digital-analog converter 330. Therefore, transmission lines of a cable such as a flexible flat cable (FFC) may be reduced, lowering the manufacturing cost of the display apparatus 100.

Figure 5:
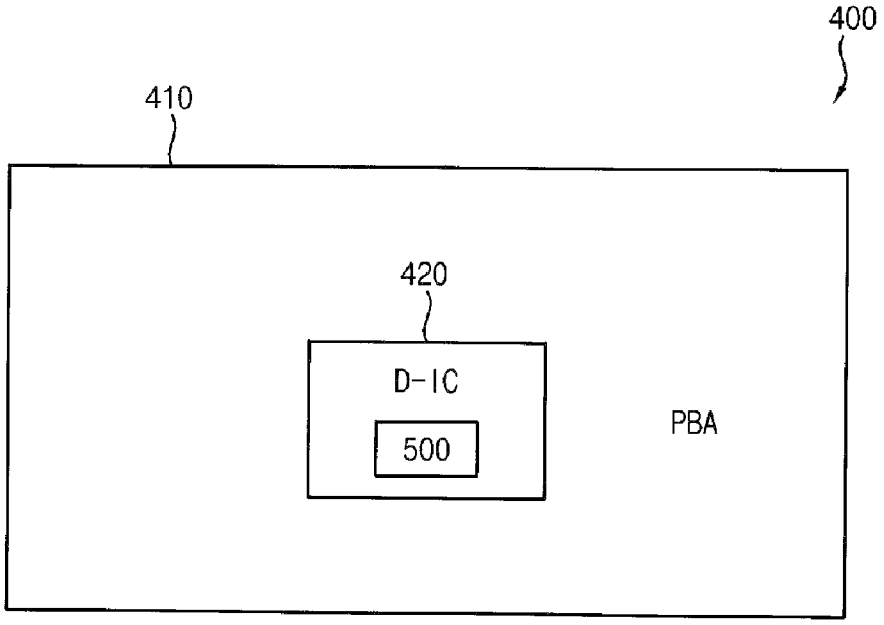
FIG. 5 is a block diagram illustrating a data driving part according to an exemplary embodiment of the present invention.

FIG. 5 is a block diagram illustrating a data driving part according to an exemplary embodiment of the present invention.

Referring to FIG. 5, the data driving part 400 includes a printed board assembly (PBA) 410 and a data driving integrated circuit 420 mounted on the PBA 410. The PBA 410 may be a substrate or a film on which the data driving integrated circuit 420 is mounted. In addition, the data driving part 400 includes a common voltage generating part 500. The common voltage generating part 500 may be in the data driving integrated circuit 420.

Figure 6:
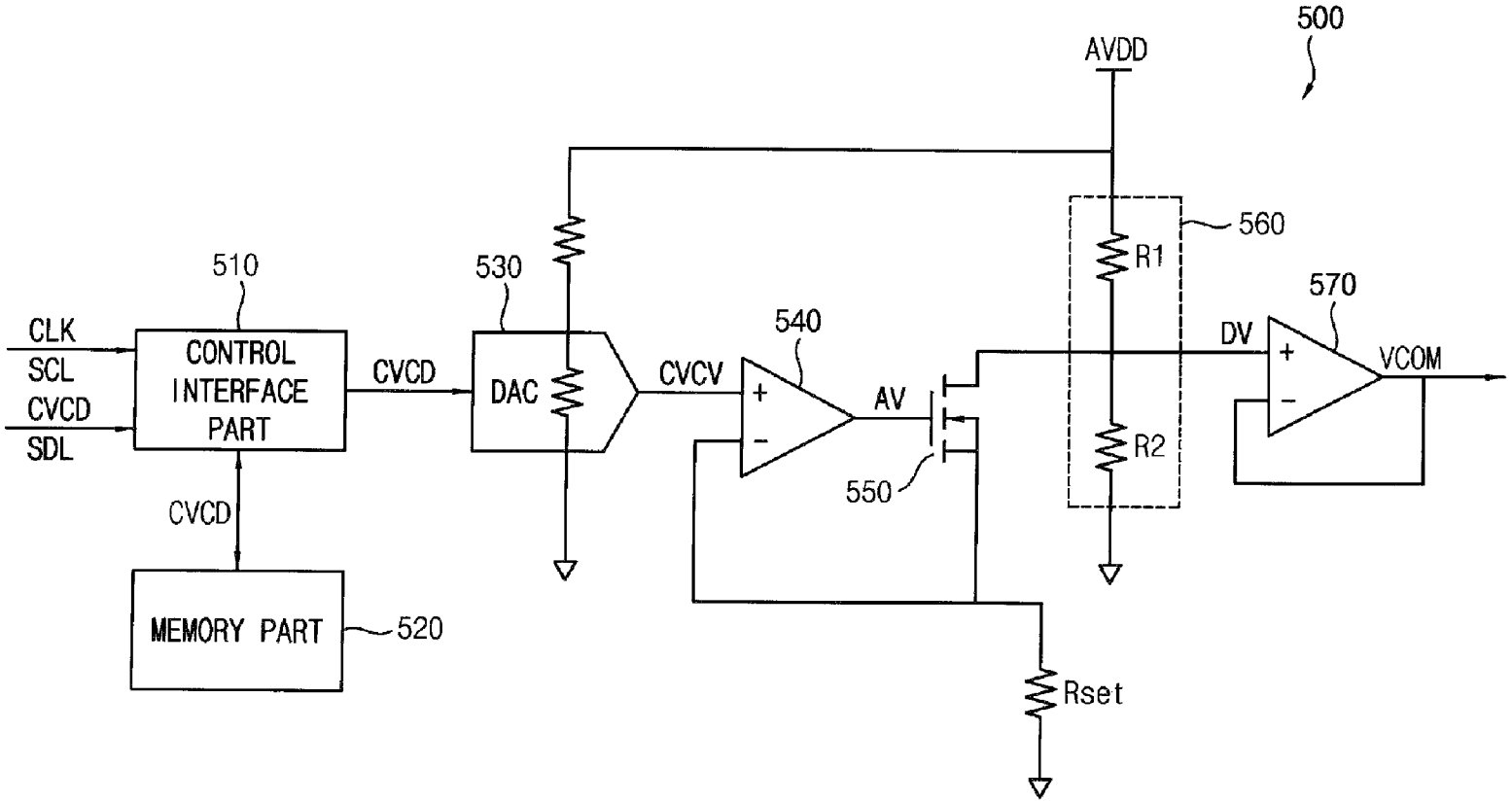
FIG. 6 is a block diagram illustrating a common voltage generating part of FIG. 5.

FIG. 6 is a block diagram illustrating the common voltage generating part 500 of FIG. 5.

Referring to FIGS. 5 and 6, the common voltage generating part 500 may include a control interface part 510, a memory part 520, a digital-analog converter 530, a first operational amplifier 540, a metal oxide semiconductor (MOS) transistor 550, a voltage distributing part 560 and a second operational amplifier 570. In the current exemplary embodiment, the control interface part 510, the memory part 520, the digital-analog converter 530, the first operational amplifier 540, the MOS transistor 350, the voltage distributing part 560 and the second operational amplifier 570 may be included in the data driving integrated circuit 420.

The control interface part 510 receives the common voltage control data CVCD from an outside to output the common voltage control data CVCD to the digital-analog converter 530. The control interface part 510 may receive the common voltage control data CVCD through an inter-integrated circuit (I2C) communication. Thus, the control interface part 510 may receive a clock signal through a serial clock line SCL and receive the common voltage control data CVCD through a serial data line SDL. The control interface part 510 may receive the common voltage control data CVCD from the timing control part 140. Alternatively, the control interface part 510 may receive the common voltage control data CVCD from the memory part 520 storing the common voltage control data CVCD. For example, the control interface part 510 may be a Unified Standard Interface for TV (USI-T).

The memory part 520 receives the common voltage control data CVCD from the control interface part 510 and stores the common voltage control data CVCD. The memory part 520 may be an electrically erasable and programmable read only memory (EEPROM) capable of repeatedly storing the common voltage control data CVCD.

The digital-analog converter 530 converts the common voltage control data CVCD to output a common voltage control voltage CVCV. The common voltage control data CVCD may be digital type and the common voltage control voltage CVCV may be analog type. The digital-analog converter 530 may include a digital variable resistor DVR to convert the common voltage control data CVCD.

The first operational amplifier 540 amplifies the common voltage control voltage CVCV to output an amplified voltage AV, including a non-inverting terminal receiving the common voltage control voltage CVCV, an inverting terminal electrically connected to a reset resistor Rset, and an output terminal electrically connected to the MOS transistor 550 outputting the amplified voltage AV. A lower limit and an upper limit of the common voltage may be determined based on the reset resistor Rset. The reset resistor Rset includes a first terminal electrically connected to the inverting terminal of the first operational amplifier 540, and a second terminal connected a terminal to which a ground voltage is applied.

The MOS transistor 550 controls a sink current according to the amplified voltage AV. For example, the MOS transistor 550 may be an NMOS transistor.

The voltage distributing part 560 includes a first resistor R1 and a second resistor R2 electrically connected to a terminal to which the analog voltage AVDD is applied, and distributes the analog voltage AVDD to output a distribution voltage DV. The first resistor R1 and the second resistor R2 are serially connected. More specifically, a first terminal of the first resistor R1 is electrically connected to the terminal to which the analog voltage AVDD is applied, a second terminal of the first resistor R1 is electrically connected to a first terminal of the second resistor R2, and a second terminal of the second resistor R2 is electrically connected to the terminal to which the ground voltage is applied.

The second operational amplifier 570 includes a non-inverting terminal electrically connected to the voltage distributing part 360 receiving the distribution voltage DV, an output terminal outputting the common voltage VCOM, and an inverting terminal electrically connected to the output terminal.

Figure 7:
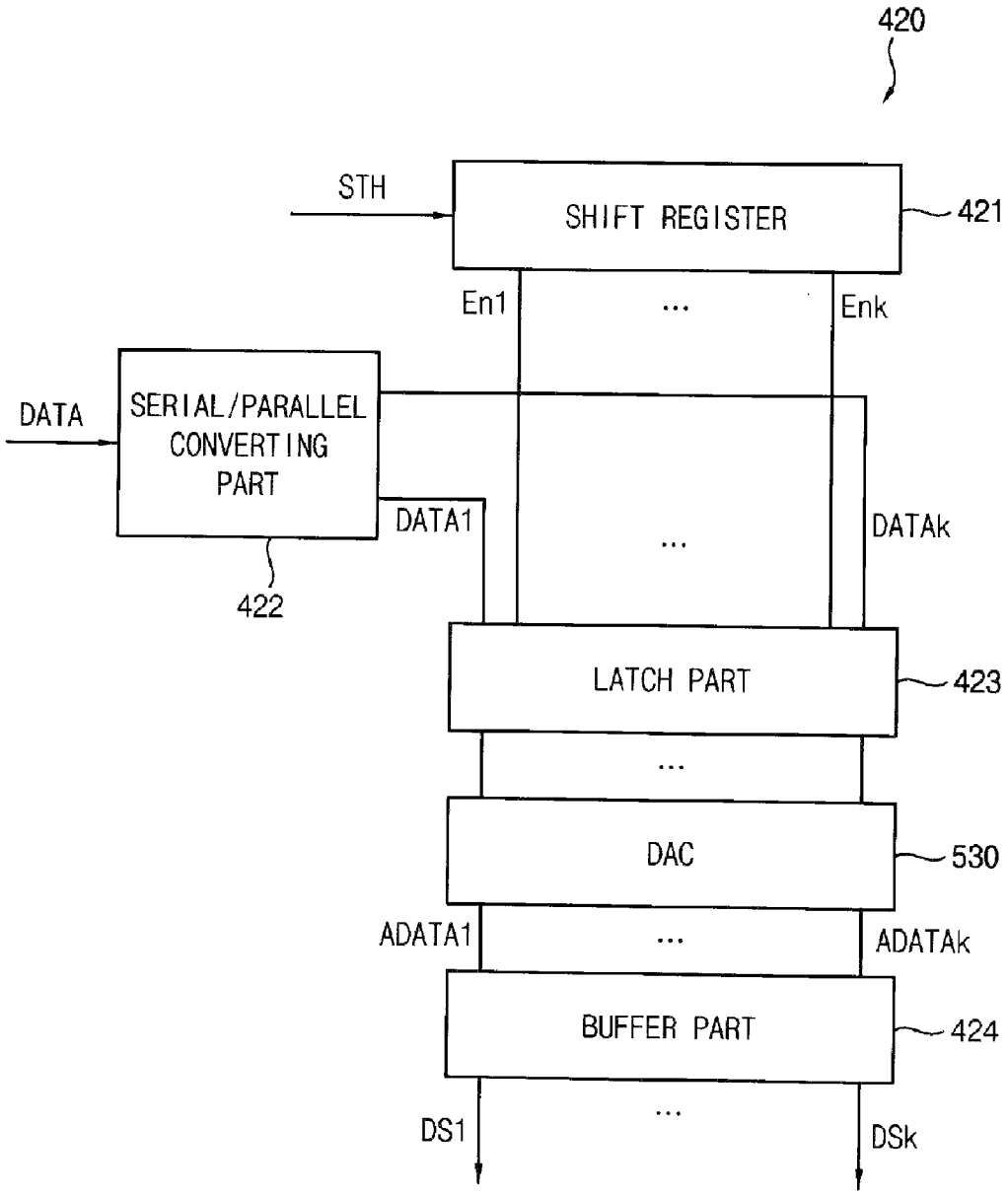
FIG. 7 is a block diagram illustrating a data driving integrated circuit of FIG. 5.

FIG. 7 is a block diagram illustrating the data driving integrated circuit 420 of FIG. 5.

Referring to FIGS. 1 and 5 to 7, the data driving integrated circuit 420 includes a shift register 421, a serial/parallel converting part 422, a latch part 423, the digital-analog converter 530 and a buffer part 424.

The shift register 421 outputs first to k-th enable signals En1-Enk in response to the data start signal STH provided from the timing control part 140.

The serial/parallel converting part 422 receives the image data DATA and converts the image data DATA into parallel type to output first to k-th parallel data DATA1-DATAk.

More specifically, the shift register 421 sequentially outputs the first enable signal En1 to the k-th enable signal Enk, sequentially storing the first parallel data DATA1 to the k-th parallel data DATAk to the latch part 423. The latch part 423 outputs the first to k-th parallel data DATA1-DATAk to the digital-analog converter 530.

The digital-analog converter 530 converts the first to k-th parallel data DATA1DATAk from the latch part 423, and outputs first to k-th analog data ADATA1-ADATAk to the buffer part 424. The first to k-th parallel data DATA1-DATAk may be digital format, and the first to k-th analog data ADATA1-ADATAk may be analog format.

The digital-analog converter 530 may be included in the data driving integrated circuit 420 and the common voltage generating part 500. Thus, the data driving integrated circuit 420 and the common voltage generating part 500 may share the digital-analog converter 530.

The buffer part 424 receives the first to k-th analog data ADATA1-ADATAk to output first to k-th data signals DS1-DSk to the data lines DL of the display panel 110. The first to k-th data signals DS1-DSk may be included in the data signals DS. According to an exemplary embodiment, the first operational amplifier 540 of the common voltage generating part 500 may be implemented using a buffer in the buffer part 424.

According to the present exemplary embodiment, the common voltage generating part 500 is in the data driving part 400, and the data driving integrated circuit 420 and the common voltage generating part 500 share the digital-analog converter 530. Therefore, transmission lines of a cable such as a flexible flat cable (FFC) may be reduced, lowering the manufacturing cost of the display apparatus 100.

According to the display panel driving apparatus and the display panel having the display panel driving apparatus, a common voltage generating part is included in a data driving part, a data driving integrated circuit of the data driving part and the common voltage generating part share a digital-analog converter. Therefore, transmission lines of a cable such as a flexible flat cable (FFC) may be reduced, lowering the manufacturing cost of the display apparatus.

The foregoing is illustrative of the present invention and is not to be construed as limiting thereof. Although a few exemplary embodiments of the present invention have been described, those skilled in the art will readily appreciate that many modifications are possible in the exemplary embodiments without materially departing from the novel teachings and advantages of the present invention. Accordingly, all such modifications are intended to be included within the scope of the present invention as defined in the claims. In the claims, means-plus-function clauses are intended to cover the structures described herein as performing the recited function and not only structural equivalents but also equivalent structures. Therefore, it is to be understood that the foregoing is illustrative of the present invention and is not to be construed as limited to the specific exemplary embodiments disclosed, and that modifications to the disclosed exemplary embodiments, as well as other exemplary embodiments, are intended to be included within the scope of the appended claims. The present invention is defined by the following claims, with equivalents of the claims to be included therein.

What is claimed is:

1. A display panel driving apparatus, comprising:

a gate driving part configured to output a gate signal to gate lines of a display panel; and a data driving part configured to output a data signal to a data line of the display panel, the data driving part comprising a digital-analog converter, wherein the digital-analog converter is configured to convert a common voltage control data of digital format to a common voltage control voltage of analog format, and wherein the data driving part further comprises a first operational amplifier configured to amplify the common voltage control voltage to output an amplified voltage, the first operational amplifier comprising a non-inverting terminal configured to receive the common voltage control voltage, an inverting terminal electrically connected to a reset resistor configured to set a lower limit and an upper limit of a common voltage, and an output terminal configured to output the amplified voltage.

2. The display panel driving apparatus of claim 1, wherein the digital-analog converter is configured to convert an image data in digital format to the data signal in analog format.

3. The display panel driving apparatus of claim 1, wherein the data driving part further comprises a control interface part configured to receive the common voltage control data and output the common voltage control data to the digital-analog converter.

4. The display panel driving apparatus of claim 3, wherein the control interface part is configured to receive the common voltage control data through an inter-integrated circuit (I2C) communication.

5. The display panel driving apparatus of claim 3, wherein the data driving part further comprises a memory part configured to receive and store the common voltage control data from the control interface part.

6. The display panel driving apparatus of claim 5, wherein the control interface part is configured to receive the common voltage control data from the memory part and provide the common voltage control data to the digital-analog converter.

7. The display panel driving apparatus of claim 5, wherein the memory part comprises an electrically erasable and programmable read only memory (EEPROM).

8. The display panel driving apparatus of claim 1, wherein the data driving part further comprises a metal oxide semiconductor (MOS) transistor configured to receive the amplified voltage and control a sink current according to the amplified voltage.

9. The display panel driving apparatus of claim 8, wherein the data driving part further comprises a voltage distributing part electrically connected to the MOS transistor, the voltage distributing part configured to distribute an analog voltage to output a distribution voltage.

10. The display panel driving apparatus of claim 9, wherein the data driving part further comprises a second operational amplifier comprising a non-inverting terminal configured to receive the distribution voltage, an output terminal configured to output the common voltage, and inverting terminal electrically connected to the output terminal.

11. The display panel driving apparatus of claim 10, wherein the data driving part further comprises:

a printed board assembly (PBA); and a data driving integrated circuit disposed on the PBA and configured to output the data signal.

12. The display panel driving apparatus of claim 11, wherein the digital-analog converter, the first operational amplifier, and the MOS transistor are included in the data driving integrated circuit.

13. The display panel driving apparatus of claim 12, wherein the voltage distributing part and the second operational amplifier are disposed on the PBA.

14. The display panel driving apparatus of claim 12, wherein the voltage distributing part and the second operational amplifier are included in the data driving integrated circuit.

15. The display panel driving apparatus of claim 1, wherein the digital-analog converter comprises a digital variable resistor (DVR).

16. A display apparatus, comprising:

a display panel configured to receive a data signal based on an image data to display an image; and a display panel driving apparatus comprising:

a gate driving part configured to output a gate signal to gate lines of a display panel; and a data driving part configured to output a data signal to a data line of the display panel, the data driving part comprising a digital-analog converter, wherein the digital-analog converter is configured to convert a common voltage control data of digital format to a common voltage control voltage of analog format, and wherein the data driving part comprises a first operational amplifier configured to amplify the common voltage control voltage to output an amplified voltage and comprising a non-inverting terminal configured to receive the common voltage control voltage, an inverting terminal electrically connected to a reset resistor configured to set a lower limit and an upper limit of a common voltage and an output terminal configured to output the amplified voltage.

17. The display apparatus of claim 16, wherein the digital-analog converter is configured to convert the image data in digital form to the data signal in analog form.

18. The display apparatus of claim 17, wherein the data driving part further comprises:

a metal oxide semiconductor (MOS) transistor configured to receive the amplified voltage and control a sink current according to the amplified voltage;

a voltage distributing part electrically connected to the MOS transistor, the voltage distributing part configured to distribute an analog voltage to output a distribution voltage; and a second operational amplifier comprising a non-inverting terminal configured to receive the distribution voltage, an output terminal configured to output the common voltage and inverting terminal electrically connected to the output terminal.

19. The display apparatus of claim 18, wherein the data driving part further comprises:

a printed board assembly (PBA); and a data driving integrated circuit mounted on the PBA and configured to output the data signal, wherein the digital-analog converter, the first operational amplifier and the MOS transistor are included in the data driving integrated circuit.

* * * * *